US005313904A

United States Patent [19]

Schmidtkunz et al.

[11] Patent Number: 5,313,904

[45] Date of Patent: May 24, 1994

[54] SAIL BOOM CLAMP

[75] Inventors: Klaus Schmidtkunz, Kassel, Fed. Rep. of Germany; Raymond Vandijk, Paia, Hi.

[73] Assignee: Neil Pryde Limited, Hong Kong

[21] Appl. No.: 48,325

[22] Filed: Mar. 17, 1993

[30] Foreign Application Priority Data

Mar. 20, 1992 [GB] United Kingdom ..... 9206137.3

[51] Int. Cl.[5] ..... B63B 15/00

[52] U.S. Cl. ..... 114/99; 114/89

[58] Field of Search ..... 114/39.2, 89, 97, 98, 114/99, 102, 103, 90; 248/74.1–74.5

[56] References Cited

U.S. PATENT DOCUMENTS

| | | | |
|---|---|---|---|
| 2,149,903 | 3/1939 | Thompson | 114/353 |
| 2,302,475 | 11/1942 | Richards | 285/77 |
| 2,725,246 | 11/1955 | Weinhold | 285/77 |
| 5,000,108 | 3/1991 | Wagner | 114/98 |

FOREIGN PATENT DOCUMENTS

| | | |
|---|---|---|
| 0299218A1 | 6/1988 | European Pat. Off. . |
| 8915739 | 6/1989 | Fed. Rep. of Germany . |
| 2200881A | 8/1988 | United Kingdom . |

*Primary Examiner*—Edwin L. Swinehart

*Attorney, Agent, or Firm*—Willian Brinks Hofer Gilson & Lione

[57] ABSTRACT

A sail boom clamp has two opposing jaws (22) and (23) which fit around a mast (2) in use to hold a sail boom in position. The effective separation of the jaws (22) and (23) can be altered by cooperation between a foot 40 on an underside of the jaw (23) and steps in an arcuate wedge (41). The wedge is moved to present different of the steps to the press against the foot (40) in use to hold the jaw in different positions relative to a body (20). The jaws are closed and held closed by an over-center clamping arrangement consisting of a handle (26) and a wire loop (24).

11 Claims, 4 Drawing Sheets

SAIL BOOM CLAMP

The invention relates to sail boom clamps.

In rigging a sail board for example, it is necessary to anchor a front end of a boom to a mast and for such purposes ties or clamps are used which securely fix the boom to the mast. It is often necessary or desirable to provide a clamp which fixes the boom at different heights up the mast and because the mast may be tapered or because somewhat different diameters of masts may be used, the clamp is preferably arranged to be adjustable to fit somewhat different diameter masts. Presently it is known to use a rope or wire closures for the clamps. The present clamps have a problem because the rope or wire must extend along a tortuous path so that the closures tend to stretch and often become overstrained in use. Further, the clamps are generally not easily or quickly fixable to the mast.

It is an object of the invention to overcome or at least reduce these problems.

According to the invention there is provided a sail boom clamp comprising a body for holding the boom, opposing jaws mounted on the body, a releasable closure for closing the jaws together firmly to and around a mast, in which one of the jaws is pivotably mounted to the body and the closure means is anchored to the body and arranged to close the jaws by pulling a free end of the one jaw towards the body and the other jaw, and adjustment means to support one of the jaws in different positions relative to the body to alter the effective separation between the jaws. Each jaw may be pivotably mounted to the body. Each jaw may be pivotably mounted about the same axis.

The closure means may be an over-centre clamping arrangement comprising a lever pivotably mounted to the body at one end and pivotably connected intermediate its length to an arm for engaging with the free end of the one jaw.

The arm may be formed by a rigid wire loop.

The adjustment means may comprise a wedge arranged to slide along between the body and one of the jaws to alter the effective separation between the jaws.

The underside of the one of the jaws may be arcuate and the wedge generally arcuate and arranged to move circumferentially with respect to the underside between the underside and the body. The underside may be formed with a foot and the wedge formed with different steps into which the foot fits, each step being arranged to support the foot a different distance away from the body.

The adjustment means may extend beyond one or both sides of the jaw to form handles to facilitate manual moving of the adjustment means to alter the effective separation.

At least the body, the jaws and the adjustment means may be formed of moulded plastics material.

A cushion of pliable material may be fixed to at least one of the jaws to bear against the mast in use.

A sail boom clamp according to the invention will now be described by way of example, with reference to the accompanying drawings, in which.

Figure 1:
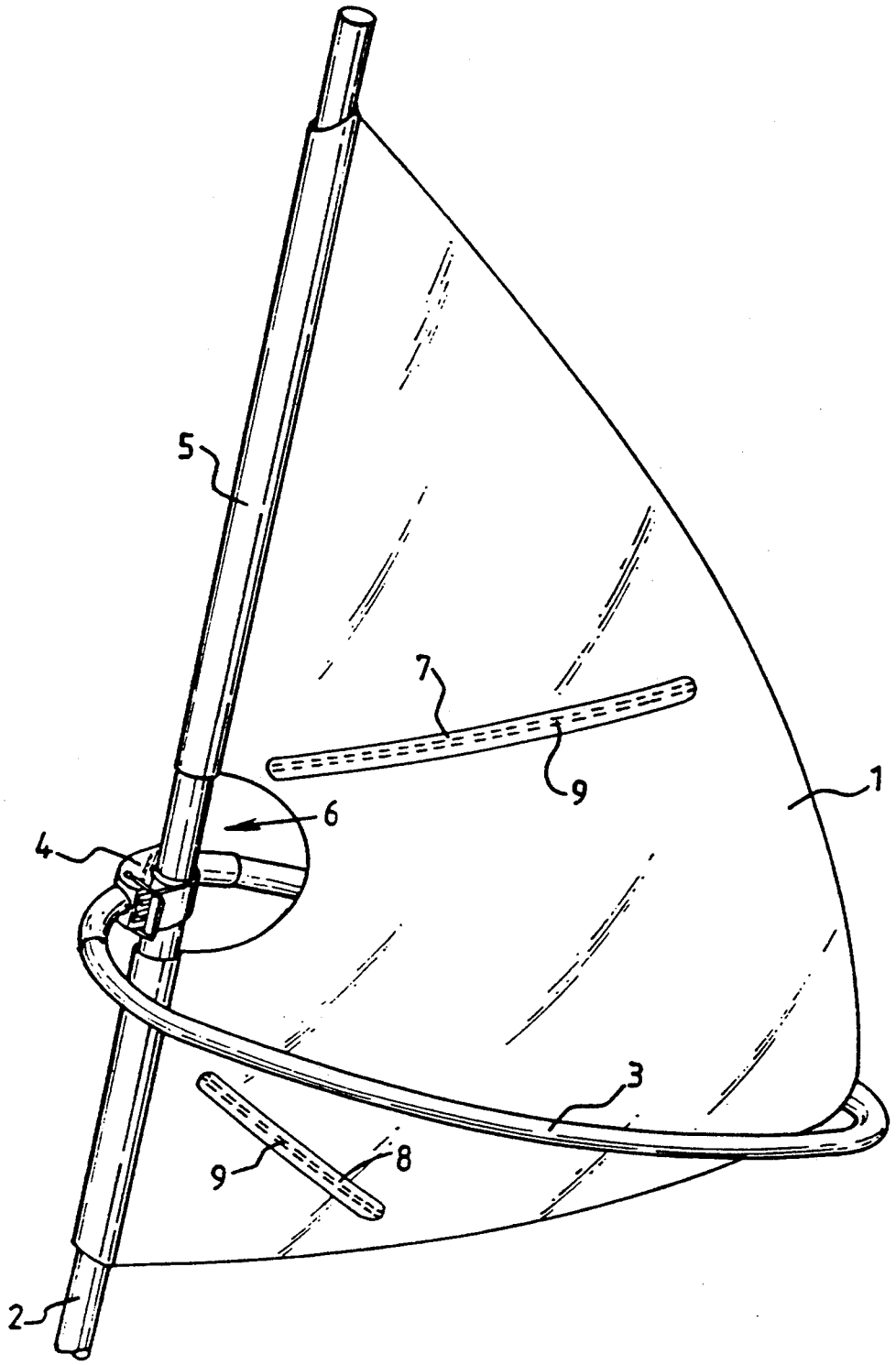
FIG. 1 is a schematic view of a sail with a boom and the clamp.

Referring to the drawings, in FIG. 1 a sail 1 for a sail board or windsurfer is mounted on a mast 2 in a usual fashion. A boom 3 serves to hold the sail out from the mast and act as a grip for the user. The boom is fitted to the mast by the boom clamp 4, described more fully below. A sleeve 5 on the leading edge of the sail encircles the mast 2 and straps or ropes (not shown) hold the sleeve in position along the mast 2. A cut-out portion 6 is provided to accommodate the boom clamp 4. Two elongate pockets 7 and 8 are formed on the sail and extend across the sail 1. Each pocket 7 and 8 is formed by a strip of material which is sewn onto the main fabric of the sail along longitudinal edges of the strips. Battens 9 fit into and extend along the length of each of the pockets 7 and 8.

Figure 2:
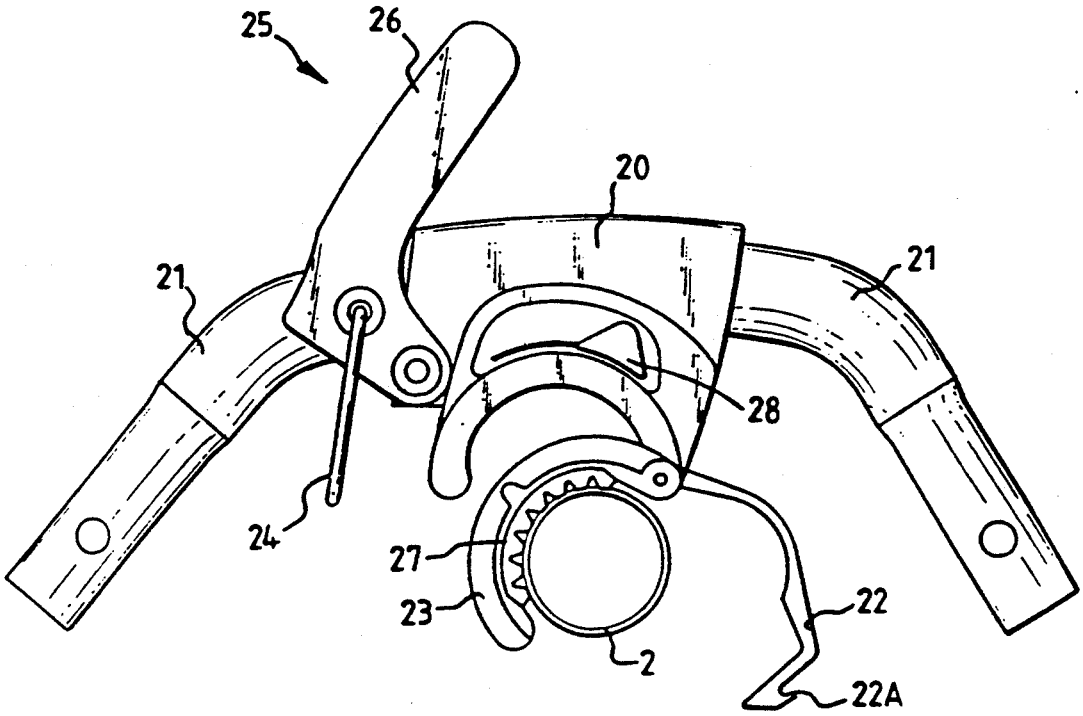
FIG. 2 is a top view of the clamp in a fully open position.
Figure 3:
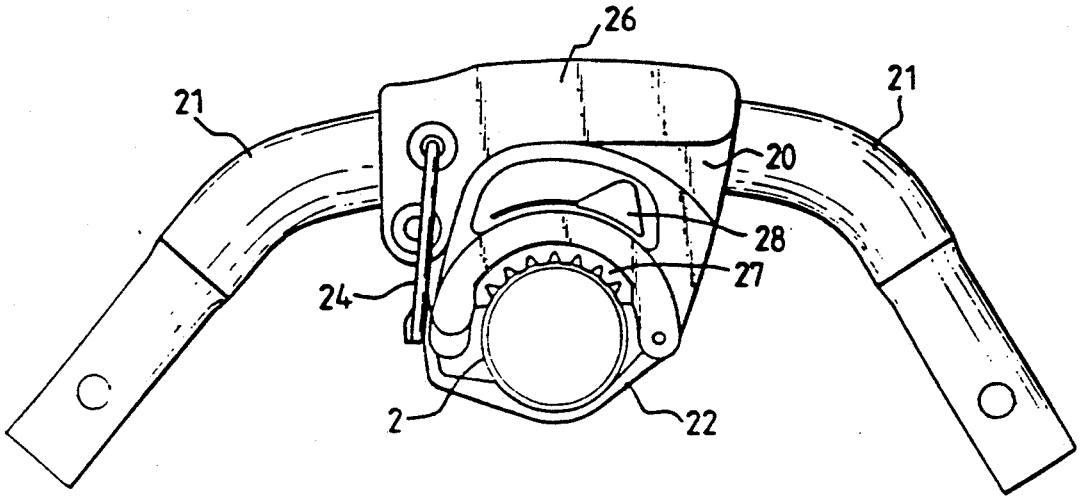
FIG. 3 is a top view of the clamp in a fully closed position.

In FIGS. 2 and 3, the clamp 4 is shown in an open and closed position respectively. The clamp has a body 20 through which a hollow tube 21 extends to each side for fixing to forward ends of the boom 3 (see FIG. 1). The tube 21 can rotate relative to the body 20. Catches (not shown) are provided to hold the ends of the boom onto the ends of the tube 21. Opposing jaws 22 and 23 are pivotably mounted on a common axle to the body 20 which in use clamp and fix the body 20 to the mast 2. The jaw 22 has an upstanding lip 22A at its free end which is gripped in use by a wire loop 24 of a closure 25. The closure 25 has a handle 26 pivotable mounted at one of its ends to the body 20. The wire loop is pivotable connected intermediate the length of the handle 26 and so that the closure 25 forms an over-centre clamping arrangement for holding the jaws 22 and 23 against the mast 2.

The jaw 23 is provided with a cushion 27 of somewhat pliable plastics material, formed with corrugations as shown, to spread the clamping load when the jaws are closed around the mast. The boom clamp can be manually adjusted by moving handles 28 positioned at each side of the body, in a manner as described below, to alter the effective separation of the jaws 22 and 23.

Figure 4:
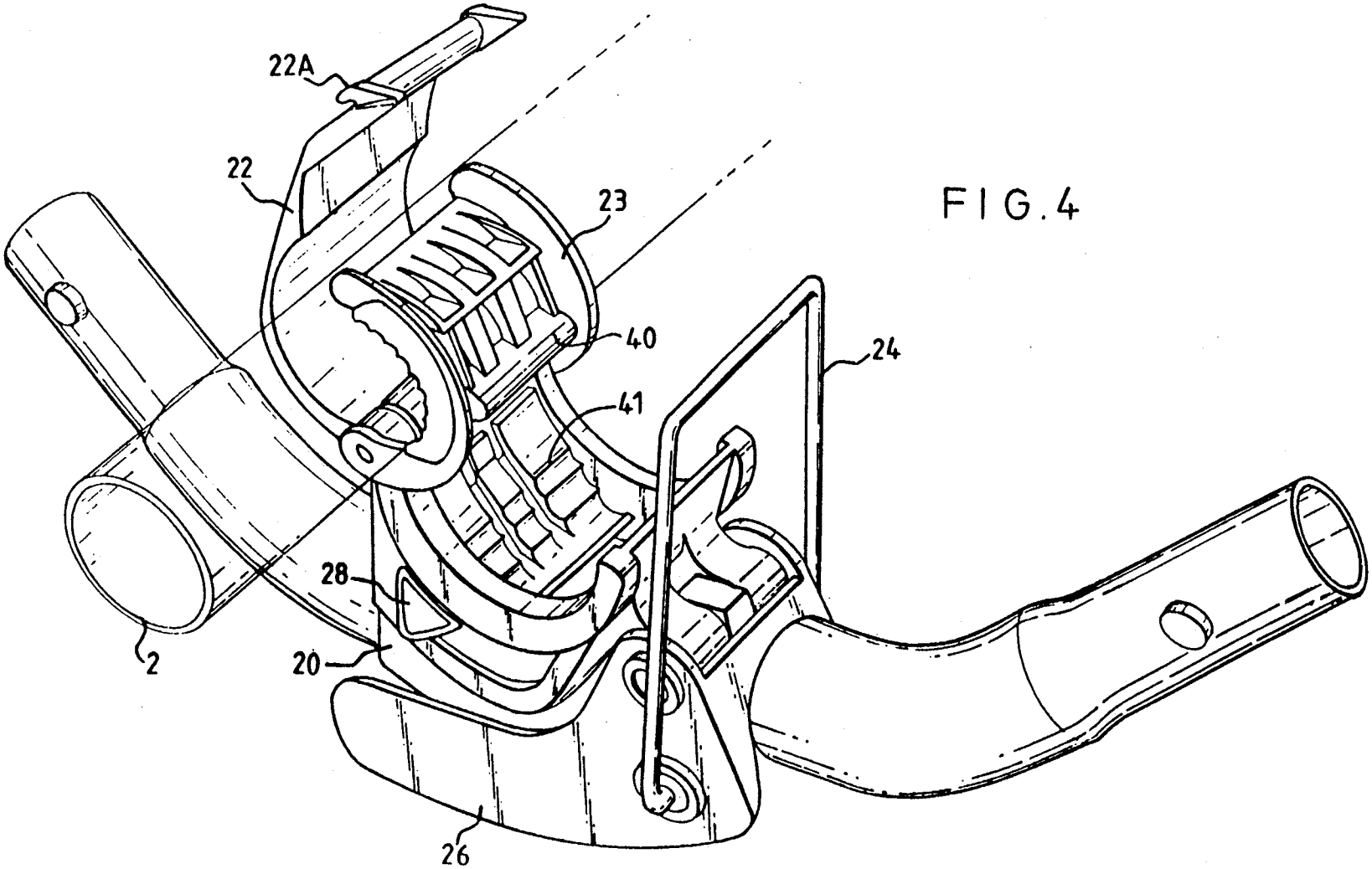
FIG. 4 is an isometric view of the clamp in a fully open position.

In FIG. 4, the internal structure of the clamp is shown clearly. The jaw 23 is formed with a transverse foot 40 which, when the jaw is pivoted to its position for closing the jaws, rests against upstanding surfaces of an arcuate wedge 41 integrally coupled to the handles 28. The wedge 41 is constrained to move along an arcuate path in the body 20 to provide, in this embodiment of the invention, three different positions or adjustments for the boom clamp.

Figure 5:
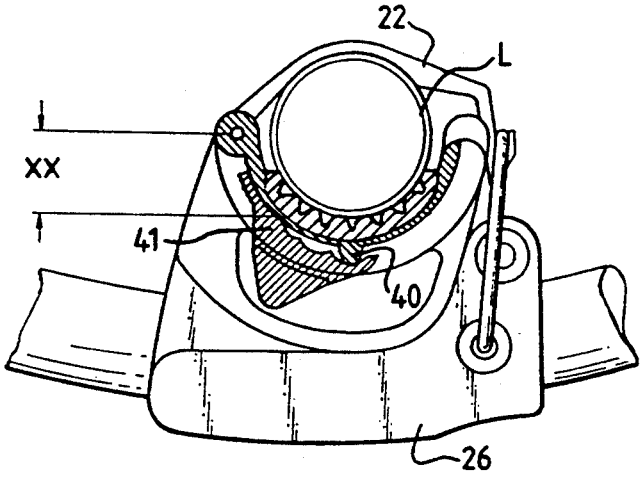
FIGS. 5, 6 and 7 are part sectional views the clamp in generally closed positions adjusted to fit different diameters of masts, in FIG. 5 the clamp is fully closed.
Figure 6:
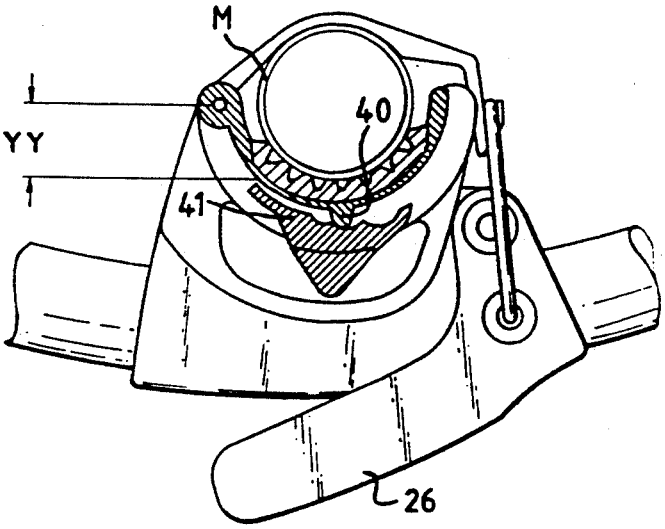
Figure 7:
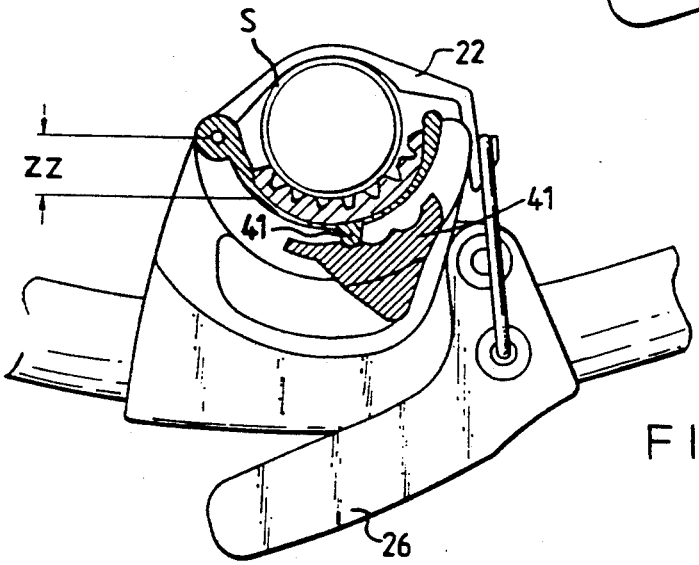

The three positions are shown in FIGS. 5 to 7. In FIG. 5, the wedge 41 in its extreme left hand position so that the effective separation of the jaws when clamped to the mast 4 is at a maximum. In FIG. 6 an intermediate position is shown and in FIG. 7 the effective separation of the jaws is at a minimum. The adjustment of the effective separation is achieved because respective steps in the wedge 41 act to hold the jaw 23 at different positions relative to the body 20 while the jaw 22 is always pulled to the same relative position by the handle 26 when the clamp is closed.

The foot 40 fits into the arcuate surfaces of the steps on the wedge 41 such that when the jaws are pulled together there is no tendency for the wedge 41 to move, to the left or right, due to the clamping forces exerted on the jaw 23. However, it will be appreciated the co-operating surface of the wedge 41 may be formed with more steps or no steps at all, simply a relatively sloping surface, and hold or support the foot 40 as required at different positions relative to the body 20.

In use, the boom clamp is offered up to the mast and the jaws closed about the mast 2. If the clamp is too loose or too tight (that is, possibly cannot be closed without straining the mast), the effective separation of the jaws is adjusted as described. The described clamp can therefore be easily and quickly fitted to the mast and adjusted as required to fit the mast firmly, even if the mast is somewhat tapered and the clamp required to fit at different positions along the mast.

What we claim is:

1. A sail boom clamp for connecting a boom to a mast, the clamp comprising a body having means to connect to the boom, opposing jaws pivotably mounted to the body, a releasable closure for closing the jaws together firmly to and around the mast, in which the closure means is anchored to the body and arranged to close the jaws by pulling a free end of the one jaw towards the body and towards the other jaw, and adjustment means arranged to support one of the jaws in different positions relative to the body to alter the effective separation between the jaws.

2. A sail boom according to claim 1, in which the jaws are pivotably mounted about a same axis.

3. A sail boom according to claim 1, in which the closure means is an over-centre clamping arrangement comprising a lever pivotably mounted to the body at one end thereof and pivotably connected intermediate its length to an arm arranged to engage with the free end of the one jaw.

4. A sail boom clamp according to claim 3, in which the arm is formed by a rigid wire loop.

5. A sail boom clamp according to claim 1, in which the adjustment means comprises a wedge and constraining means arranged to constrain the wedge to slide along between the body and one of the jaws to alter the effective separation between the jaws.

6. A sail boom clamp according to claim 5, in which the underside of the one of the jaws is arcuate and the wedge is generally arcuate and the constraining means is arranged to constrain the wedge to slide circumferentially with respect to the underside between the underside and the body.

7. A sail boom clamp according to claim 6, in which the underside is formed with a foot and the wedge is formed with different steps circumferentially separated from one another into which steps the foot can fit, each step being arranged to support the foot a different distance away from the body.

8. A sail boom according to claim 6, in which the adjustment means extends beyond at least one side of a jaw to form a handle to facilitate manual moving of the adjustment means to alter the effective separation.

9. A sail boom according to claim 7, in which the adjustment means extends beyond at least one side of a jaw to form a handle to facilitate manual moving of the adjustment means to alter the effective separation.

10. A sail boom according to claim 1, in which the body, the jaws and the adjustment means are formed of molded plastics material.

11. A sail boom according to claim 1, including a cushion of pliable material fixed to one of the jaws and arranged to bear against a surface of the mast.

* * * * *